US007967160B2

(12) United States Patent
Rault et al.

(10) Patent No.: US 7,967,160 B2
(45) Date of Patent: Jun. 28, 2011

(54) ASSEMBLY FOR STORAGE AND DISPENSING OF UNIT OBJECTS, EQUIPPED WITH A FIRST-OPENING SEAL

(75) Inventors: Stephane Rault, Paris (FR); Laurent Stoufflet, Chatenay-Malabry (FR); Jacquy Lebon, Challands (FR)

(73) Assignee: Airsec (Societe Par Actions Simplifiee), Choisy le Roi (FR)

( * ) Notice: Subject to any disclaimer, the term of this patent is extended or adjusted under 35 U.S.C. 154(b) by 540 days.

(21) Appl. No.: 12/034,961

(22) Filed: Feb. 21, 2008

(65) Prior Publication Data

US 2008/0210712 A1 Sep. 4, 2008

(30) Foreign Application Priority Data

Feb. 23, 2007 (FR) ..... 07 01300

(51) Int. Cl.
*B65D 41/32* (2006.01)
*B65D 17/34* (2006.01)

(52) U.S. Cl. ..... 215/255; 220/270

(58) Field of Classification Search ..... 220/270, 220/266, 265, 260, 212.5, 212, 259.5, 255.1, 220/255, 254.1, 200, 203.19, 203.01; 215/257, 215/255, 254, 253, 250, 305, 295, 261, 228, 215/311, 307, 200; 222/562, 563, 545, 544, 222/153.14, 153.07, 153.06, 153.05; 221/266, 221/263, 260; 206/532, 528; D9/438, 440, D9/439, 449, 447, 435; *B65D 17/347, 17/34, B65D 17/28, 41/32, 43/02*

See application file for complete search history.

(56) References Cited

U.S. PATENT DOCUMENTS

| | | | | | |
|---|---|---|---|---|---|
| 1,628,108 | A * | 5/1927 | Brown et al. | 312/31.1 |
| 1,881,772 | A * | 10/1932 | Maas | 222/344 |
| 2,317,882 | A * | 4/1943 | Boesel | 96/148 |
| 2,735,566 | A * | 2/1956 | Bramming | 222/552 |
| 3,369,707 | A * | 2/1968 | Porter et al. | 222/83 |
| 3,434,620 | A * | 3/1969 | Laurizio | 220/258.2 |
| 4,765,499 | A * | 8/1988 | von Reis et al. | 215/261 |
| 4,834,234 | A | 5/1989 | Sacherer et al. | |
| 4,934,545 | A * | 6/1990 | Pezzoli et al. | 215/250 |
| 5,088,613 | A * | 2/1992 | Dutt et al. | 215/250 |
| 5,125,522 | A * | 6/1992 | Pezzoli et al. | 215/250 |
| 5,924,605 | A * | 7/1999 | Baudin et al. | 222/494 |
| 5,938,053 | A * | 8/1999 | Verbovszky et al. | 215/6 |
| 6,142,337 | A * | 11/2000 | Schreckenberg et al. | 221/263 |
| 2001/0052531 | A1 * | 12/2001 | Randall et al. | 222/521 |
| 2006/0219727 | A1 * | 10/2006 | Giraud | 220/839 |
| 2007/0257046 | A1 * | 11/2007 | Rault et al. | 220/675 |

FOREIGN PATENT DOCUMENTS

| | | | |
|---|---|---|---|
| EP | 0337484 | | 10/1989 |
| EP | 0355471 | | 2/1990 |
| FR | 2863968 | A1 * | 6/2005 |
| JP | 7187218 | | 7/1995 |

* cited by examiner

*Primary Examiner* — Anthony Stashick
*Assistant Examiner* — Robert J Hicks
(74) *Attorney, Agent, or Firm* — Dennison, Schultz & MacDonald

(57) ABSTRACT

An assembly for storage and controlled dispensing of unit products, constituted by a container for bulk storage of the products, a device for reclosably closing the container, including a dehydrating device, and a flow-limiting device for dispensing products. The flow-limiting device includes (a) a tearable membrane connected to the edge of the dispensing aperture and totally blocking the aperture and equipped with a gripping and pulling device, and (b) a passage allowing for a gas exchange and preventing, by virtue of its restricted dimensions, the dispensing of the packaged products.

20 Claims, 3 Drawing Sheets

ASSEMBLY FOR STORAGE AND DISPENSING OF UNIT OBJECTS, EQUIPPED WITH A FIRST-OPENING SEAL

FIELD OF THE INVENTION

The invention relates to an assembly for bulk storage and unit dispensing of objects having an oblong, cylindrical or spherical shape, such as tablets, lozenges, capsules, coated pills or pills, sensitive to moisture, in particular in the field of pharmaceutical products, which storage and dispensing assembly is formed by a sealed tubular container, equipped with a dispensing device and a dehydrating cap associated with the dispensing device.

For obvious reasons, in particular hygiene, but also to prevent any degradation and thus to improve the preservation time of drugs or pharmaceutical products, they are protected from external contamination and/or physicochemical degradation resulting from the relative humidity level, light, in particular UV rays and other chemical substances, or degradation due to mechanical effects.

Also for reasons of hygiene, preservation and protection, numerous dispensing devices have been envisaged so as to allow for dispensation, either unit-by-unit, or by at most several units at a time of said pharmaceutical products, such as tablets, lozenges, capsules, coated pills, or pills, so as to prevent any contamination due to an unintentional discharge of a large number of objects, which must then be reinserted into the container.

Moreover, such a assembly consisting of the container, dehydrating cap and flow limiter must have a tamperproof function, more specifically a first-opening seal function, so as to reassure the consumer of the integrity of the product that he or she is about to consume.

DESCRIPTION OF RELATED ART

The first-opening seal function of a closed assembly, formed by a container, a device for dispensing pharmaceutical products such as tablets, lozenges, capsules, coated pills, or pills, and dehydrating cap-type closure means, is generally provided by a cooperation between the container and the closure means, i.e. the cap.

Pharmaceutical containers, for the most part, indeed comprise a packaging and a cap-type closure means and are actually equipped with a first-opening seal, positioned between the container and the closure means. This first-opening seal, sometimes incorrectly called a tamperproof seal, is generally constituted, for example, by a plurality of micro-connections connecting all or part of the lower peripheral surface of the closure means to all or part of the upper peripheral surface of a ring or a neck, or to any attachment system, such as a ring, securely connected to the packaging by any mechanical means, such as, for example, press fitting without the possibility of disassembly.

These micro-connections are connection micro-points, separate from one another but forming an edge or a simple toothed connection area between the closure means and the ring or the neck or more generally the system attaching said closure means to the packaging.

These micro-points are broken in the first opening of the container by the user, by the application of a breakage force exerted on the closure means in the upward vertical direction, if it is a simple connection by scored micro-points between the ring or neck securely connected to the packaging and the closure means, or in the horizontal direction by a circular tearing movement if it is a double row of breakage points of, for example, a detachable intermediate connection collar positioned between the ring securely connected to the packaging and the closure means.

The first user performs this destructive action and is thus assured that he or she is indeed the first user, insofar as he or she can verify whether or not the micro-point connection is still present, or whether or not the collar is still present.

These tamperproof systems with a first-opening seal are well known, and, having demonstrated their capabilities, nevertheless require a definitive connection without the possibility of disassembly of the open end of the packaging and the ring securely connected to the closure means by means of the scored micro-points, with the breakage of the connection micro-points occurring upon opening.

These tamperproof systems also require the user to exert an upward force so as to break the scored micro-points in the first opening. Even though it is relatively easy to use such a force with reclosable hinged cap-lid-type closure means, equipped in particular with a cover, it is much more difficult to exert such a force with a simple cap. A lever arm facilitating this breakage by exertion of this force is actually possible with such a cap-lid, in particular equipped with a cover, although it is not possible with a simple cap.

Finally, such a system of scored micro-points positioned between a ring or neck and cap-type closure means is nevertheless difficult to produce with multi-cavity molds using the mold injection means operating at substantially high speeds. The molds become complex insofar as they must incorporate mobile elements leaving the space between the upper surface of the ring or neck and the lower surface of the closure means free.

We thus consider this first-opening seal function integrated in the dispensing device/unit product flow limiter, positioned between the closure means and the packaging space, and no longer integrated in the closure means working in cooperation with the packaging, to be meaningful and relevant.

Devices for dispensing objects with a substantially oblong, cylindrical or spherical shape, such as tablets, lozenges, capsules, sugar-coated pills and other drugs or pharmaceutical products, packaged in bulk in a container, are amply described in the technical literature. In particular in that constituted by the patent applications and/or published patents.

Document U.S. Pat. No. 6,142,337 describes a pill dispenser including a container closed at its upper part by a non-removable lid, and, at its lower part by a base in the shape of a hollow cup, comprising an off-center dispensing aperture, mobile in rotation about the axis of symmetry of the container. The rotation of said cup, with an off-center dispensing aperture, makes it possible to block said aperture insofar as a diaphragm securely connected to the container covers the off-center dispensing aperture when the cup is rotated. Such an assembly does not comprise a cap and is not suitable for packaging products sensitive to moisture. The mechanical device making it possible to block the dispensing aperture by rotation of the cup after delivery of a pill does not ensure tightness of the assembly thus constituted, with respect to the surrounding environment. In addition, said pill dispenser does not comprise a first-opening seal.

Other limited-flow dispensing devices with a simpler design are also available on the market. In particular, there is an assembly including a tubular container, at its open end, dispensing means, as well as cap-type closure means, which are fitted into the dispensing means and close the latter tightly.

Said dispensing means are in the shape of a simple hollow cup comprising an off-center dispensing aperture, which is fitted by its external cylindrical part into the internal cylindrical part of the open end of the tubular container.

The cap-type closure means comprise an external cylindrical surface that fits tightly with the internal cylindrical surface of the cup. The closure means constituted by the cap may or may not comprise a dehydrating device. They can also comprise flanges that partially block the dispensing aperture when being positioned and regardless of the angular position adopted by the closure means when the latter are introduced into the dispensing means constituted by the hollow cup.

Pharmaceutical products such as tablets, lozenges, capsules, coated pills, and pills are dispensed, either unit-by-unit or several units at a time when the user turns over the assembly constituted by the container equipped with its flow-limiting dispenser, once the closure means have been removed.

Such an assembly does not comprise the first-opening seal.

It can be observed that no dispensing device of the prior art equipping containers provides satisfactory results, not so much at the level of the dispensing of the products for which it is designed, but rather at the level of the integration of other functions, such as the first-opening seal, while being capable of enabling an active cap to control the internal atmosphere, for example the moisture of the container when it closes said container.

SUMMARY OF THE INVENTION

The problem stated and not yet solved by the prior art thus appears to be that of providing an assembly for storage, in a moisture-controlled atmosphere, and dispensing, of solid unit products, packaged in bulk, simultaneously equipped with a flow-limiting dispenser making it possible to preferably dispense said contained products unit-by-unit, and means associated with said dispenser constituting the first-opening seal of said assembly.

For this reason, a first objective of the invention is to create a flow-limiting dispenser that makes it possible to prevent the inadvertent discharge of more than one unit product at a time, when it is being used.

A second objective of the invention is to create a flow-limiting dispensing device that makes it possible to maintain an internal controlled atmosphere in the storage container, not only before the first opening of the container by the user, but also when it is being used, by the presence of adsorption capacities enabling in situ treatment of the gaseous atmosphere of the container.

Another objective of the invention is that of creating a storage and dispensing assembly including a tubular container, a flow-limiting device for dispensing unit products in solid state comprising a first-opening seal and a reclosable dehydrating cap, which assembly has a simple design, is inexpensive to produce and is easy to use.

A final objective of the invention is to create a flow-limiting dispensing device that makes it possible to verify, by the presence or absence of a particular seal, the first opening of said container by the user.

The invention thus relates to an assembly for storage and controlled dispensing of unit products, constituted by a bulk storage container of said products, means for reclosably closing the container having dehydrating means, and a flow-limiting device for dispensing products, equipped with an upper face and a lower face, a cylindrical peripheral skirt, at least one guide surface leading to a dispensing aperture and attachment means on the container, characterized in that the flow-limiting device comprises:

a) a tearable membrane connected to the edge of the dispensing aperture and totally blocking said aperture and equipped with gripping and pulling means, b) a passage allowing for a gas exchange between the two faces, but preventing, by virtue of its restricted dimensions, the dispensing of packaged products.

DETAILED DESCRIPTION OF THE INVENTION

According to the invention, the storage and dispensing assembly is composed of a container for sensitive products to be packaged, a flow-limiting device with a first-opening seal and reclosable tight closure means comprising dehydrating cap-type means for treating the internal atmosphere of the container, in particular its relative moisture level.

The flow-limiting device with a first-opening seal has an upper face, a lower face and a peripheral cylindrical skirt, a dispensing aperture, a tearable membrane connected, on the one hand, to gripping and pulling means and, on the other hand, to the edge of the dispensing aperture and totally blocking the dispensing aperture, and a passage allowing a gas exchange between the closure means equipped with treatment means, such as a dehydrating cap, and the products packaged in the container, and preventing, by virtue of restricted dimensions, the dispensing of the packaged products, which flow-limiting device is inserted into the neck of the container with which it is associated. The tamper protection of the storage and dispensing assembly is proven by the presence of the membrane securely connected to the edge of the dispensing aperture and the proof of an early first opening by a third party other than the user. The tight closure of the container is ensured by closure means equipped with means for treating the internal atmosphere of the container, which tightness is ensured, before and after the first opening, by the closure means.

The flow-limiting device comprises an inlet located on its lower face, at least one guide surface that may or may not have an axis of symmetry of which the surface may or may not be developable, and an outlet that leads to the dispensing aperture if there is a tubular connection between the outlet of the guide surface and the dispensing aperture, or that constitutes the dispensing aperture, when there is not tubular connection, which device has means for attachment to the associated container.

The flow-limiting device belonging to the assembly according to the invention, can advantageously be designed in the form of a thin-walled structure, such as an empty cap or a hollow cup, capable of being obtained by plastic processing.

This flow-limiting device also comprises an external peripheral surface, such as a peripheral skirt, preferably cylindrical, on which the attachment means for definitively and tightly assembling the device to the container are placed.

According to a particular but very simple and often sufficient design with respect to the needs of users of pharmaceutical products such as tablets, lozenges, capsules, coated pills or pills to be dispensed, preferably unit-by-unit or several units at a time, the upper face, the lower face, the guide surface, the dispensing aperture, and the tearable membrane connected to the edge of the dispensing aperture and totally blocking said dispensing aperture can be in the same plane perpendicular to the axis of the container and therefore merge in a single wall. The shape of the device is then truly that of a hollow cup with a substantially flat base.

Inlet:

The flow-limiting device with a first-opening seal belonging to the storage and dispensing assembly, according to the invention, comprises an inlet on its lower face leading to the guide surface.

The inlet of the guide surface can, for example, have a circular, elliptical or polygonal cross-section according to the cross-section of the container. It is, however, preferably circular, so as to simplify the machining work. This cross-section is no greater than the internal cross-section of the neck of the container to which the device is tightly attached.

Guide Surface:

The flow-limiting device with a first-opening seal according to the invention, belonging to the storage and dispensing assembly, comprises at least one surface for guiding products to be dispensed. A first guide surface is preferably located on the lower face of the device, upstream of the dispensing aperture, and is oriented toward the inside of the container in contact with the products to be dispensed.

A second guide surface can be located on the upper face of the device, downstream of the dispensing aperture, and is oriented toward the opening of the container in order to return any excess of products dispensed by the dispensing aperture to the container.

The first and the second guide surfaces can simultaneously be associated in the flow-limiting device.

The guide surface is advantageously in the form of a wall defining a hollow volume with a spherical surface, such as a cap or a spherical, frusto-conical, cylindro-frusto-conical, frusto-parabolic, or frusto-hyperbolic area, which surfaces have a straight or oblique revolution, i.e. are generated by a rectilinear line or a curvilinear line.

The hollow volume thus defined has a height and a base of which the ratio between the height and the dimension of its base can be very low or even zero in the extreme case of a planar guide surface.

In the case of a conical guide surface, the angle at the top of the cone can be between 30° and 180° and preferably between 45° and 135°.

The guide surface forming a wall is open at both of its ends. One of the openings, the largest, is oriented toward the inside of the container and constitutes the inlet of the device for the products to be dispensed. The other opening leads to or constitutes the aperture for dispensing and limiting the flow of said products, by virtue of its specially designed shape.

Thus all of the geometric shapes of the guide surfaces, making it possible to pass from the internal section of the container neck to the internal cross-section of the main dispensing aperture and to position this aperture possibly preferably with respect to the axis of the container can be considered.

In addition, one and/or the other of the guide surfaces can be concave or convex when seen from the inside of the container. In a particular configuration, the upper face of the device can constitute a second guide surface, with the first guide surface appearing to be convex. This second guide surface then works as an aid not for the extraction of the unit products, but for returning them to the container by a reverse path, by means of the dispensing aperture, owing to this second guide surface, if more than one unit products are dispensed and are therefore present in the cavity located between the upper face of the device and the open end of the container or the base of the closure means. This arrangement is more specifically indicated if the unit products are spherical and capable of rolling.

In a particularly simple and extreme design, as mentioned above, the at least one guide surface can be a planar surface comprising the dispensing aperture.

Dispensing Aperture:

According to the invention, the storage and dispensing assembly comprises a dispensing aperture downstream of the guide surface, causing the lower face and the upper face of the flow-limiting device to communicate, and enabling the passage of the products to be dispensed, unit-by-unit, from the inside to the outside of the container.

The guide surface leads to the dispensing aperture of the device or forms, by its small open end, the dispensing aperture.

The dispensing aperture can have various cross-sections, preferably circular, elliptical or polygonal or have any other shape according to the shape and size of the products to be dispensed. This aperture has dimensions that enable a single product to pass at a time. Thus, if the dispensing aperture is circular, its diameter is generally close to the length or the diameter of the product to be dispensed.

The dispensing aperture is set back, i.e. it is below the level of the plane constituted by the upper peripheral surface of the cylindrical skirt of the device.

The dispensing aperture can be positioned at the center, i.e. in the axis of the flow-limiting device. But, in other designs, the main dispensing aperture can be positioned outside the axis of symmetry of the flow-limiting device, such as, for example, at the periphery or at any other point on the upper face of the device.

First-Opening Seal:

According to the invention, the flow-limiting device comprises a tearable membrane connected to the edge of the dispensing aperture, which tearable membrane totally blocks the dispensing aperture, and is equipped with gripping and pulling means for tearing said membrane, which gripping and pulling means are advantageously a ring.

The device belonging to the assembly according to the invention comprises a dispensing aperture that is substantially set back with respect to the plane of the upper peripheral surface of the cylindrical skirt of the device, thus freeing a space between the dispensing aperture and the base of the reclosable closure means equipped with dehydrating cap-type means for controlling the internal atmosphere of the container.

The user can thus, in a first use, remove the dehydrating cap, check for the presence of the first-opening seal, i.e. the membrane blocking the dispensing aperture, then tear, by pulling on the gripping and pulling means, i.e. the ring, the tearable membrane, thus freeing the dispensing aperture. The device thus equipped with the tearable membrane and its gripping ring is produced by injection and made of a single material.

This membrane is connected to the edge of the dispensing aperture by a single thin continuous integral connection such as a tearable film or a plurality of scored micro-points.

Passage Enabling the Gas Exchange:

The device belonging to the assembly according to the invention comprises a passage enabling a gas exchange between the dehydrating cap-type closure means equipped with treatment means and the products packaged in the container, with said flow-limiting device being inserted into the neck of the container with which it is associated. This passage, by virtue of its restricted dimensions, cannot enable the dispensing of packaged products.

This passage can be constituted by the gaps remaining free between the scored micro-points connecting the first-opening seal membrane to the edge of the dispensing aperture.

This passage can also be constituted by holes, slots, orifices or open spaces positioned at any point on the lower surface or the guide surface of the device or directly on the first-opening seal membrane, and its size is small enough for said packaged products not to be capable of passing through said holes, slots, orifices or open spaces when the assembly is turned over for the extraction of one of the packaged products.

Means for Attaching the Flow-Limiting Device in the Container Neck:

The flow-limiting device belonging to the storage and dispensing assembly, according to the invention, also comprises attachment means on the internal surface of the container and/or on the neck of the container with which it is associated.

Preferably, the attachment means are positioned on the external peripheral surface of the device, i.e. on the peripheral skirt.

Various attachment means can be envisaged, such as, for example, press fitting, clipage with groove and ring, on one or the other of the surfaces present, differential thermal shrinkage, screwing, pawl and ratchet and the like. However, the preferred attachment means are constituted by a press fitting between the preferably cylindrical external surface of the flow-limiting device and the preferably cylindrical internal surface of the container neck.

Said attachment means make it possible to ensure the tightness between the inside and the outside of the container when the external peripheral surface of said device is not cylindrical but has an olive-type bulge.

The attachment means also comprise means for vertically positioning the device with respect to the neck of the associated container, preventing the vertical movement of the latter once positioned, in particular in the case of press fitting.

Such means can be constituted, for example, by a collar abutting the container neck or in a peripheral recess provided in the container neck.

The upper face of the flow-limiting device inserted into the container neck is at most flush with the peripheral surface of the container neck, or is supported on said surface, by way of support means, which can be a preferably cylindrical collar of which the diameter is greater than the internal diameter of the container neck and no greater than the external diameter of the container neck. Said collar is located at the level of the upper annular surface of the device.

Such a collar prevents excessive pressing of the device into the container neck and ensures its precise vertical positioning.

Additional positioning and anti-return means participating with the attachment means can also be constituted by a ring system fitting a groove provided on the internal cylindrical surface of the container and cooperating with the ring arranged on the external cylindrical surface of the skirt of the flow-limiting dispensing device.

Such means can also constitute an undercut anti-return stop, positioned at the level of the lower surface of the device and preventing the device from leaving the neck of the container to which it is attached.

A plurality of connection means including means for attachment and positioning of the device with respect to the container neck can be used simultaneously.

In a preferred configuration, the upper surface of the cylindrical skirt of the device levels the upper surface of the container, so as to prevent any possibility of extraction of the device by any protuberance that may exist, possibly facilitating its extraction and therefore impairing the first-opening seal function associated with said device, which has been tampered with by a simple disassembly of said device.

Means for Closing the Flow-Limiting Device:

The flow-limiting device belonging to the storage and dispensing assembly, according to the invention, is tightly closed, by a dehydrating cap, thus closing the container filled with the sensitive packaged products.

The tightness is achieved between the internal cylindrical surface of the skirt of the device and the external cylindrical surface of the dehydrating cap.

An olive shape with a bulge positioned on the external cylindrical surface of the dehydrating cap and fitting a corresponding hollow shape existing on the internal surface of the cylindrical skirt of the device makes it possible to ensure the opening and the tight closing of the device, with the opening and closing force being suitable for easy use by any user.

The dehydrating cap is well known from the prior art and comprises a chamber for storing active dehydrating products, which can be powdered or solid. In the case of powdered products, this storage chamber is sealed by a sheet porous to moisture.

The upper periphery of the dehydrating cap can comprise means facilitating handling, such as, for example, ridges or a certain surface roughness.

The assembly composed of a storage container and a dispensing flow-limiting device, according to the invention, can be equipped with means for closing the open end of the body of said container, which can also be any cap/lid, for example with a hinge, and with a design making it possible to ensure tightness between the device and the cap/lid.

Mode of Operation:

According to the mode of operation of the storage and dispensing assembly, and when the packaged products are being dispensed, the user first opens the dehydrating cap, accesses the freed space with the untampered membrane, tears, by pulling, the means for gripping said membrane, thus guaranteeing that the storage and dispensing assembly has not previously been opened. The user turns the storage and dispensing assembly over so that the stock of products to be dispensed is located at the top of the dispensing device and in contact with the guide surface thereof.

By way of gravity, the products to be dispensed successively come into contact with the guide surface, then with the dispensing aperture of which the appropriate size enables the passage preferably of a single product of a time.

Production of the Device:

The flow-limiting device belonging to the storage and dispensing assembly, according to the invention, is preferably produced by mold injection techniques with thermoplastic materials.

Other production techniques can also be used, such as single- or multi-layer extrusion and sheet cutting by any extrusion or calendering technique followed by thermoforming, then punching and cutting so as to obtain said device. The blow-molding injection can also be considered. However, mold injection is preferably chosen.

Well-known plastic materials can be used to form the device and include high- and low-density polyethylenes, free-radical or linear, ethylene copolymers such as, for example, vinyl acetate ethylenes, ethyl-acrylate ethylenes, butyl-acrylate ethylenes, maleic anhydride ethylenes and alfa-olefin ethylenes, regardless of the modes of polymerization or modification by grafting, homo polypropylene and copolymers, polybuten-1 and polyisobutylene. Polyolefins, for reasons of cost and ease of use, are preferably chosen to produce the device.

Other polymer materials can nevertheless be considered, such as polyvinyl chloride, vinyl chloride copolymers, polyvinylidene chlorides, polystyrenes, styrine copolymers, cellulose derivatives, polyamides, polycarbonates, polyoxymethylenes, polyethylene-terephthalates, polybutylene-terephthalates, copolyesters, polyphenylene-oxides, polymethyl-methacrylates, acrylate copolymers, fluorinated polymers, polyphenylene-sulfides, polyarylsulfones, polyaryletherketones, polyetherimides, polyimides, thermoplastic elastomers, polyurethanes, phenyl resins, melamine resins, urea resins, epoxide resins and unsaturated polyester resins.

Biodegradable polymer materials, for example, starch-based, are also possible, such as, for example polylactic acids (PLA).

Combinations of these polymers can be used. The polymer used to produce the flow-limiting device can also contain one or more additives such as elastomers, fibers, expansion agents, additives such as stabilizers and coloring agents, slip agents, mold release agents, and adhesion or reinforced attachment agents, according to the implementation requirements.

Use of Various Parts Involved in the Production of the Assembly Up to the Packaging Line:

According to a first preferred embodiment of the various parts involved in the production of the assembly, the cap-type closure means and the flow-limiter are pre-assembled by the manufacturer as a sub-assembly, prior to the final assembly on the packaging line. The sub-assembly is delivered to the packager, who receives the containers separately. The unit products are placed in the container on the packaging line, then said container is closed by the sub-assembly, which is then assembled definitively on the filled container. The final assembly is done by the packager, in one operation, thus facilitating the packaging process, in particular allowing for packaging on standard packaging machines, according to a simplified packaging process, as opposed to an assembly of three components on a packaging line.

Once assembled, the flow limiter is locked definitively and irreversibly in the upper part of the tubular container. The attachment means between the container and the flow limiter thus appears to be a combination of two separate means, a ring and groove assembly and a press fitting resulting in particular from the fact that the cap has previously been inserted into the flow limiter. Indeed, the diameter of the external cylindrical skirt of the flow limiter involved in the sub-assembly thus produced becomes slightly greater than the internal diameter of the neck of the container, hence the press fitting assembly. In addition, the presence of the cap in the flow limiter, constituting said sub-assembly makes it possible, by creeping over time, for the ring and groove attachment means to be improved, i.e. the ring present, for example, on the external periphery of the cylindrical skirt of the device and the groove present on the internal cylindrical wall of the container neck conform to one another.

According to a second mode of use on the packaging line, the container is previously filled with the products to be dispensed before receiving the flow-limiting device. The filled container equipped with its flow-limiting device is then closed definitively by the reclosable dehydrating cap on the packaging line.

Thus, such a storage and dispensing assembly is used preferably to dispense, unit-by-unit, a supply of sensitive products to be dispensed, which are stored pending use and protected from the surrounding environment. Said storage and dispensing assembly guarantees to the user, who observes the presence of the first-opening seal on the dispensing device, that the package has not been opened prior to the user's purchase.

BRIEF DESCRIPTION OF THE DRAWINGS

The invention can be better understood in view of the following numbered description of figures, which are provided solely for illustrative and non-limiting purposes, of the storage and controlled dispensing assembly according to the invention.

DESCRIPTION OF THE PREFERRED EMBODIMENTS

Figure 1:
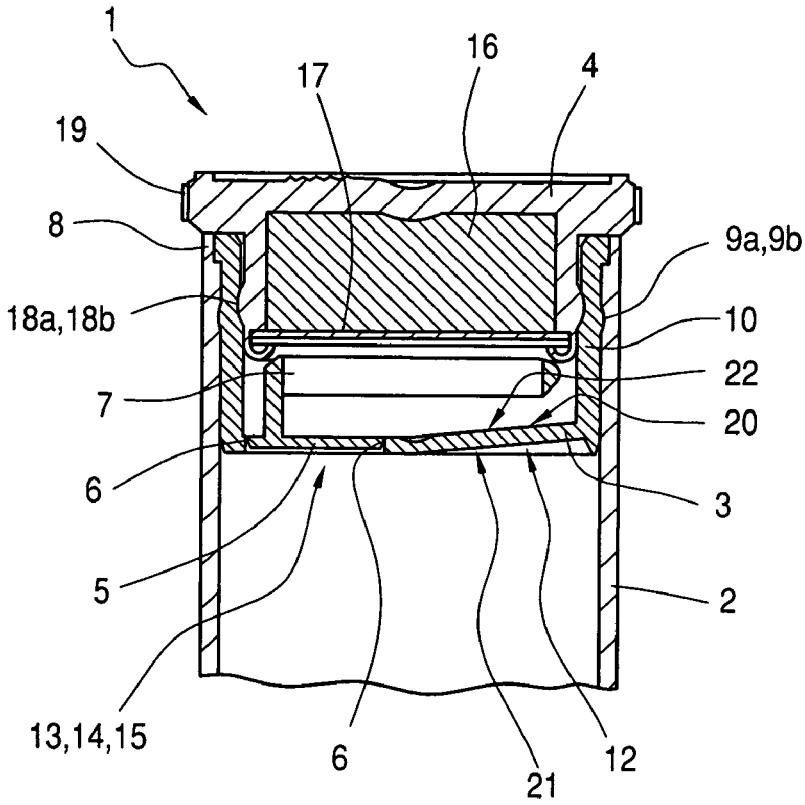
FIG. 1 shows a cross-section view of the assembly according to the invention, including the storage container of which the lower part is not shown, equipped with the flow-limiting device with a first-opening seal, associated with its container, at the level of the neck of said container and a reclosable dehydrating cap. The first-opening seal assembly has not yet been torn.

FIG. 1 shows a cross-section view of the assembly (1) including the storage container (2) and the flow-limiting device (3) with a first-opening seal, according to the invention, as well as the reclosable dehydrating cap (4).

This flow-limiting device (3) with a first-opening seal comprises a scored membrane (5), i.e. capable of being torn, associated with the edge of the dispensing aperture by a breakable attachment (6), such as a fine continuous film-type area or a plurality of small scored connectors (micro-points). The pulling ring (7) securely connected to the membrane (5) makes it possible to tear said scored first-opening seal membrane (5) by tearing the continuous film area or breaking a plurality of small scored connectors, i.e. micro-points, if micro-points are used.

This flow-limiting device with a first-opening seal is inserted into the neck of the container so that its upper annular surface is at most flush with the peripheral surface of the container neck, thus preventing any risk of gripping for possible disassembly.

Said device is associated with its container, at the level of the neck of said container. Its vertical positioning is ensured by a shoulder (8).

The press fitting assembly of the flow-limiting device (3) with a first-opening seal in the neck of the container and the impossibility of its extraction is achieved by a system of a ring (9*a*) fitted to a groove (9*b*) formed on the internal cylindrical surface of the container (2) and cooperating with the ring (9*a*) arranged on the external cylindrical surface of the skirt (10) of the flow-limiting dispensing device (3).

At the level of its architecture, the flow-limiting device with the first-opening seal (3) comprises an inlet (13) facing the inside of the container, which is, in this specific case, located in the plane of the substantially convex guide surface (12), and which thus merges with the dispensing aperture (15), an outlet (14) the leads to the dispensing aperture (15), also in the plane of the guide surface (12), and which thus also merges with the dispensing aperture (15). A second guide surface (22) located on the upper face (20) of the device ensures the return of a possible excess of products that have been dispensed by the aperture.

The dehydrating cap (4) comprises dehydrating means (16), held by a porous sheet (17) itself held by a mounting implemented by overturning a ferrule.

The tightness between the reclosable dehydrating cap (4) and the dispensing device (3) with a first-opening seal is achieved by an olive-type bulging system (18*a*) arranged on the external cylindrical surface of the closure means (4) fitted to a recess (18*b*) and cooperating with said recess formed on the internal cylindrical surface of the skirt (10) of the device.

The reclosable dehydrating cap (4) is supported on the neck of the container (2) as well as on the upper end of the device (3), which are level, i.e. forming a single plane, by means of a boss. The reclosable dehydrating cap 4) can comprise, on the external periphery of this boss, ridges (19) so as to facilitate gripping.

There is a space available between the partition forming the backside of the substantially convex dispensing surface (12), i.e. the upper face of the device (20) and the base of the reclosable dehydrating cap (4), which makes it possible to house the bent tearing ring (7) enabling the tearable first-opening seal membrane (5) to be torn.

Figure 2:
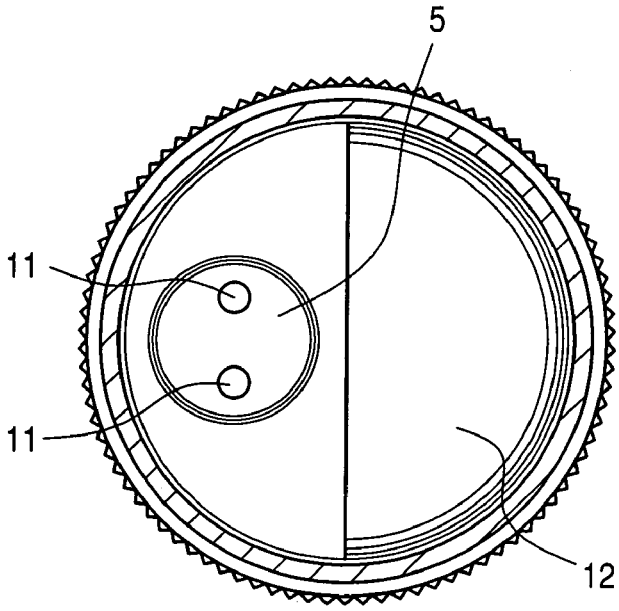
FIG. 2 shows a bottom view, from the inside of the container, of the assembly according to the invention, including the storage container, the flow-limiting device with a first-opening seal and the reclosable dehydrating cap. The first-opening seal membrane has not yet been torn. The passage of gas is made possible by the presence of two holes formed on the circular first-opening seal membrane, which has not yet been torn.

FIG. 2 shows the passage of gas (11) through two holes formed in the tearable first-opening seal membrane (5) connected to the partition constituting the guide surface (12) of the device (3).

The verification of the presence of the first-opening seal constituted by the tearable or scored membrane (5) can be done only after opening the reclosable dehydrating cap (4). The tearing of the scored membrane (5) is performed by pulling the ring (7), which pulling enables the breakable attachment (6) in the form of the connection film or the connection points to be torn, thus freeing the dispensing aperture (15).

Figure 3:
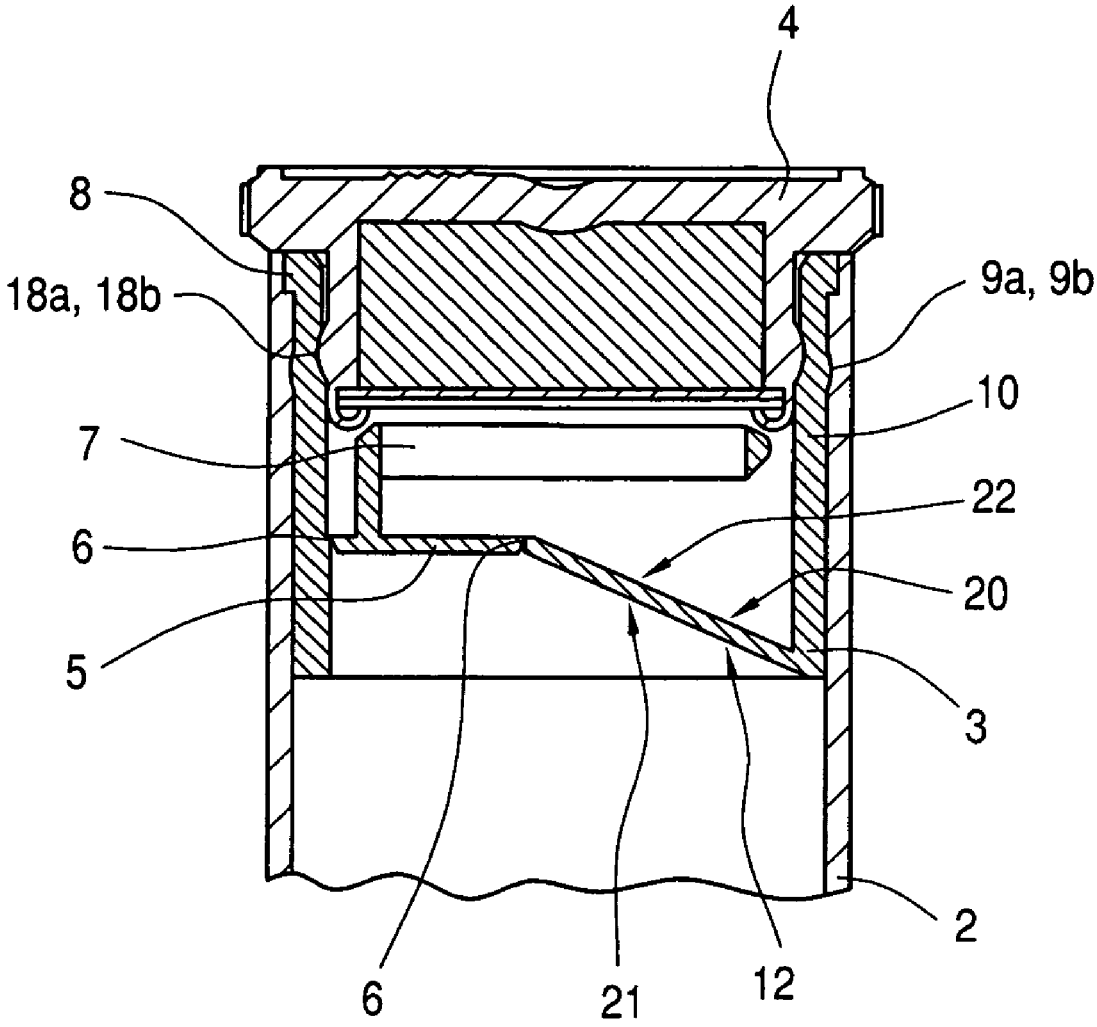
FIG. 3 shows a cross-section view of the assembly according to the invention, including the storage container of which the lower part is not shown, equipped with the flow-limiting device with a first-opening seal in an alternative showing an off-center frustoconical dispensing surface. The first-opening seal assembly has not yet been torn.

FIG. 3 shows a cross-section view of the assembly (1) including the storage container (2) and the flow-limiting device (3) with a first-opening seal, according to the invention, as well as the reclosable dehydrating cap (4).

This flow-limiting device (3) with a first-opening seal comprises a scored membrane (5), i.e. tearable, associated with the edge of the dispensing aperture by a fine continuous film-type area or by scored micro points, both constituting the breakable attachment (6). The pulling ring (7) securely connected to the membrane (5) makes it possible to tear said scored first-opening seal membrane (5), by tearing the fine continuous area or by breaking a plurality of small scored connectors, i.e. micro-points, if micro-points are used.

This FIG. 3 corresponds to an alternative of FIG. 1 showing an off-center concave, not substantially planar, frusto-conical dispensing surface (12). The upper (20) and lower (21) faces of the device are also shown.

Figure 4:
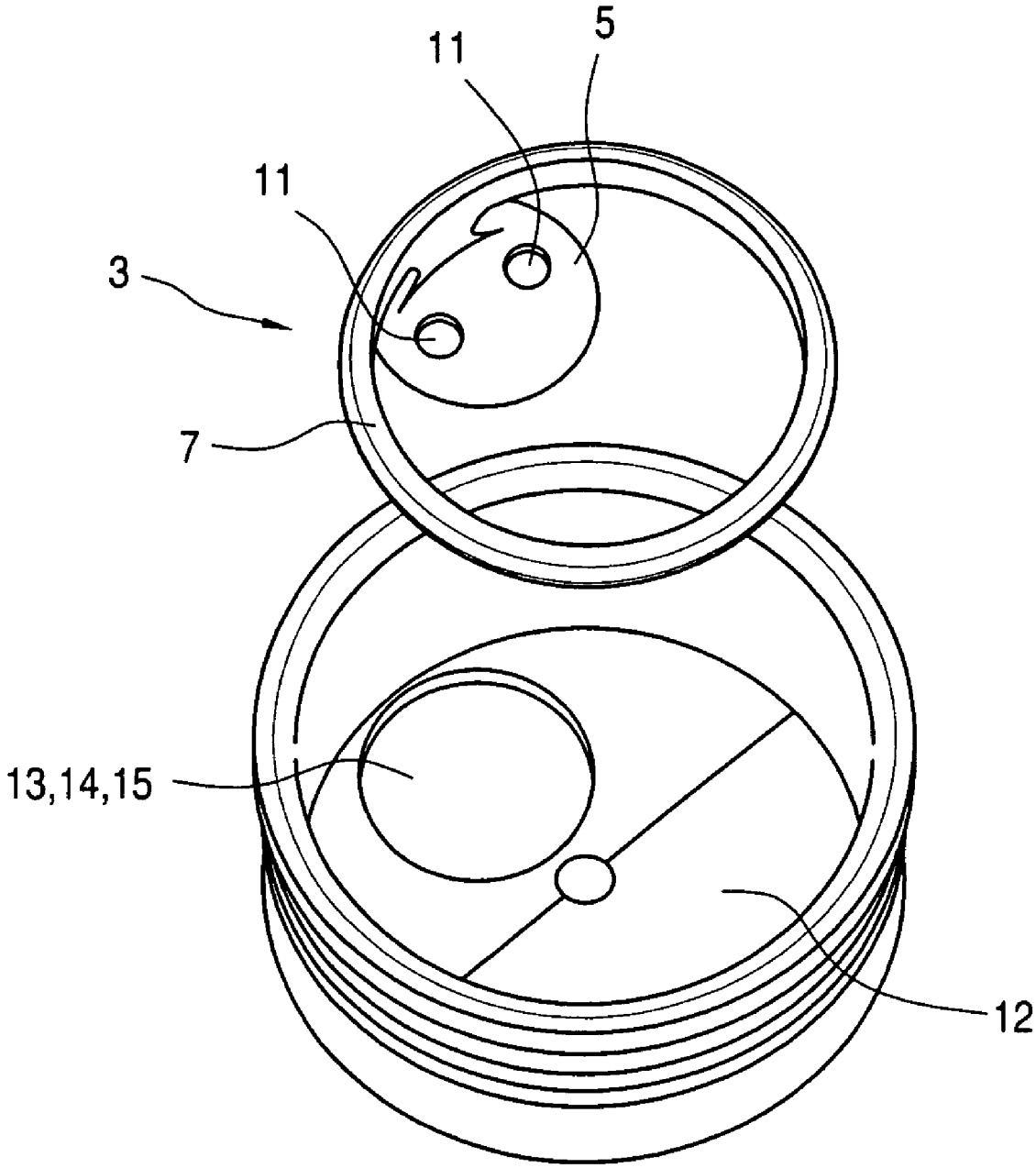
FIG. 4 shows a top view in perspective of the flow-limiting device alone, separate from its first-opening seal membrane securely connected to the gripping ring used to attach it.

FIG. 4 shows a top view in perspective of the flow-limiting device (3) alone, separate from its first-opening seal membrane (5) securely connected to the gripping ring (7) used to attach it.

FIG. 4 also shows the passage of gas (11) through two holes formed in the scored first-opening seal membrane (5) connected to the partition constituting the guide surface (12) of the device.

It also shows the aperture (15) for dispensing the packaged products to be dispensed, preferably unit-by-unit, and the backside of the guide surface (12).

Such an assembly is used for packaging pharmaceutical products on a mass production line, which products may include tablets, lozenges, capsules, coated pills, pills and other solid unit drugs, packaged in bulk in a tight container with a moisture-level controlled atmosphere, by means of a reclosable dehydrating cap, during phases of storage and use of said pharmaceutical products, which products are to be dispensed to a final user/consumer, unit-by-unit, or at most several units at a time, wherein said final user/consumer can be assured of the physical integrity of the assembly by the observed presence of a membrane acting as a first-opening seal, which is still present on the device, and the observed presence after opening of the reclosable dehydrating cap.

What is claimed is:

1. Assembly for storage and controlled dispensing of unit products, comprising:

a container for bulk storage of the products, a closing device for reclosably closing the container, the closing device having dehydrating means therein, and a flow-limiting device for dispensing products, equipped with an upper face and a lower face, a cylindrical peripheral skirt, at least one guide surface leading to a dispensing aperture and attachment means to the container, the flow-limiting device being disposed within the container between a container portion in which the products are stored and the closing device, the flow-limiting device further comprising:

a) a tearable membrane connected to an edge of the dispensing aperture and totally blocking the aperture and equipped with gripping and pulling means, and b) a passage allowing for a gas exchange between the lower face and the upper face, but preventing, by virtue of restricted dimensions of the passage, dispensing of packaged products therethrough.

2. Assembly according to claim 1, wherein the tearable membrane is connected to the edge of the dispensing aperture by a thin continuous integral connection of a tearable film, or a plurality of scored micro-points.

3. Assembly according to claim 1, wherein the gripping and pulling means securely connected to the tearable membrane (5) is a ring.

4. Assembly according to claim 1, wherein the passage allowing a gas exchange between the two faces of the device is constituted by holes, slots, orifices or open spaces positioned at any point on the lower surface or the guide surface of the device or directly on the tearable membrane.

5. Assembly according to claim 1, wherein the passage allowing a gas exchange between the two faces of the device is constituted by gaps which remain free between scored micro-points connecting the tearable first-opening seal membrane to the edge of the dispensing aperture.

6. Assembly according to claim 1, wherein the flow-limiting device has an inlet having a circular, elliptical or polygonal cross-section.

7. Assembly according to claim 1, wherein the flow-limiting device has an inlet having a cross-section no larger than an internal cross-section of the neck of the container.

8. Assembly according to claim 1, wherein the guide surface of the flow-limiting device is a spherical, frusto-conical, cylindro-frusto-conical, frusto-parabolic, or frusto-hyperbolic surface, which surfaces have a concave or convex straight or oblique revolution.

9. Assembly according to claim 1, wherein the guide surface of the flow-limiting device is a planar surface comprising the dispensing aperture.

10. Assembly according to claim 1, wherein the dispensing aperture has a circular, elliptical or polygonal cross-section.

11. Assembly according to claim 1, wherein the dispensing aperture is outside of an axis of symmetry of the device.

12. Assembly according to claim 1, wherein the dispensing aperture is substantially set back with respect to a plane of the upper annular surface of the skirt of the device, thus freeing a space between said aperture and the base of the closure means.

13. Assembly according to claim 1, wherein the attachment means of the flow-limiting device is positioned on the external peripheral surface of the skirt of the device.

14. Assembly according to claim 1, wherein the attachment means of the flow-limiting device is a press fitting, clipping between a groove and ring, differential thermal shrinkage, screwing or pawl and ratchet attachment.

15. Assembly according to claim 14, wherein the attachment means of the flow-limiting device comprises a system of a ring fitted to a groove formed on the internal cylindrical surface of the container and cooperating with the ring arranged on the external cylindrical surface of the skirt of the flow-limiting dispensing device.

16. Assembly according to claim 1, wherein the attachment means of the flow-limiting device comprises a support means which enables vertically positioning the flow-limiting device with respect to an associated neck of the container, which support means comprises a collar abutting the neck of the container or placed in a circular recess shoulder provided in the neck of the container.

17. Assembly according to claim 1, wherein an upper annular surface of the cylindrical skirt of the device is level with an upper surface of the container.

18. Assembly according to claim 1, wherein the dispensing device comprises a recess formed on the internal cylindrical surface of the skirt, cooperating with an olive shaped bulge arranged on the external cylindrical surface of the closure means.

19. Assembly according to claim 1, wherein the flow-limiting device is produced by injection of thermoplastic material.

20. Method for packaging unit products with an assembly according to claim 1, wherein the closure device and the flow-limiting device are pre-assembled by a manufacturer in a sub-assembly, prior to final assembly on a packaging line in order to close the container.

* * * * *